US010470492B2

(12) United States Patent
Fath

(10) Patent No.: US 10,470,492 B2
(45) Date of Patent: Nov. 12, 2019

(54) DISPLAY PACKAGE

(71) Applicant: Altria Client Services LLC, Richmond, VA (US)

(72) Inventor: Scott A. Fath, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days.

(21) Appl. No.: 13/843,314

(22) Filed: Mar. 15, 2013

(65) Prior Publication Data

US 2014/0262871 A1 Sep. 18, 2014

(51) Int. Cl.
*A24F 15/02* (2006.01)

(52) U.S. Cl.
CPC ..... *A24F 15/02* (2013.01)

(58) Field of Classification Search
CPC ..... B65D 5/4204
USPC ..... 206/769, 273, 446, 775, 779, 781, 236, 206/232; 229/161, 162.1, 162.7
See application file for complete search history.

(56) References Cited

U.S. PATENT DOCUMENTS 2,162,089 A * 6/1939 Kagen ..... B65D 5/0254 206/777
D117,986 S 12/1939 Weiss
2,354,239 A * 7/1944 Williamson ..... B65D 5/0005 206/273
D147,120 S 7/1947 Dietrich
2,464,951 A * 3/1949 Stengren ..... 206/765
2,611,529 A 9/1952 Currivan
2,727,620 A * 12/1955 Buttery et al. ..... 206/779
2,854,182 A 9/1958 Dodd
2,913,101 A 11/1959 Daily
2,937,743 A 5/1960 Buttery et al.
2,948,390 A 8/1960 Wagaman
2,980,242 A * 4/1961 Miller ..... 206/781
D190,772 S 6/1961 Cuyler
3,029,934 A 4/1962 Hennessey
3,033,357 A 5/1962 Vogel
(Continued)

FOREIGN PATENT DOCUMENTS

CN 1436145 A 8/2003
CN 1910084 A 2/2007
(Continued)

OTHER PUBLICATIONS

Notification of Transmittal of the International Search Report dated Jun. 12, 2014, by the International Searching Authority, in corresponding International Appln. No. PCT/US2014/022719, dated Jun. 12, 2014 (5 pages).
(Continued)

*Primary Examiner* — Robert Poon
(74) *Attorney, Agent, or Firm* — Harness, Dickey & Pierce, P.L.C.

(57) ABSTRACT

A display package configured to receive an elongate body, which includes a rectangular box portion having a side edge cavity formed between a front panel and a cavity side panel, wherein the side edge cavity includes a first cavity panel and a second cavity panel formed by an outer portion of the front panel and the cavity side panel, respectively, and wherein the rectangular box portion, the first cavity panel and the second cavity panel are perpendicular to the front panel and the cavity side panel, respectively.

30 Claims, 6 Drawing Sheets

(56) References Cited

U.S. PATENT DOCUMENTS

| | | | | |
|---|---|---|---|---|
| 3,054,505 | A | 9/1962 | Hennessey | |
| 3,186,622 | A * | 6/1965 | Palmer | B65D 5/4204 229/102 |
| 3,206,098 | A | 9/1965 | Stenger et al. | |
| 3,233,726 | A * | 2/1966 | Gero | 229/120.15 |
| 3,298,504 | A | 1/1967 | Carter | |
| 3,326,444 | A | 6/1967 | Farquhar et al. | |
| D218,212 | S | 7/1970 | Pfrommer | |
| 3,521,810 | A | 7/1970 | Boyer | |
| 3,659,704 | A | 5/1972 | Collura et al. | |
| 3,680,687 | A * | 8/1972 | D'Alessio | B65D 5/4204 206/783 |
| 3,767,037 | A | 10/1973 | Anderson | |
| 3,828,923 | A | 8/1974 | Phillips, Jr. | |
| 4,106,615 | A | 8/1978 | Hiroshi | |
| 4,109,786 | A | 8/1978 | Roccaforte et al. | |
| 4,125,185 | A * | 11/1978 | Bliss | B65D 5/4204 206/426 |
| 4,342,417 | A | 8/1982 | Forbes, Jr. | |
| 4,353,694 | A | 10/1982 | Pelerin | |
| 4,397,393 | A | 8/1983 | Pergande et al. | |
| 4,487,311 | A | 12/1984 | Lavery | |
| 4,524,871 | A | 6/1985 | Klinger | |
| D290,175 | S | 6/1987 | Bakic | |
| 4,848,563 | A | 7/1989 | Robbins | |
| 4,865,204 | A | 9/1989 | Vance | |
| 4,957,202 | A | 9/1990 | Yoshiki et al. | |
| D314,146 | S | 1/1991 | Scholz | |
| D318,802 | S | 8/1991 | Egide | |
| 5,044,548 | A * | 9/1991 | Olsen et al. | 229/120.03 |
| 5,226,534 | A | 7/1993 | Kim | |
| D353,712 | S | 12/1994 | Aalders | |
| D371,959 | S | 7/1996 | Hupp | |
| 5,848,690 | A * | 12/1998 | Granger et al. | 206/315.9 |
| 5,944,183 | A * | 8/1999 | Rowland | B65D 5/48024 206/232 |
| 6,050,416 | A | 4/2000 | Blin et al. | |
| 6,244,501 | B1 * | 6/2001 | Choi | 229/120.01 |
| 6,460,703 | B1 * | 10/2002 | Thompson et al. | 206/779 |
| D466,406 | S * | 12/2002 | Solland | D9/418 |
| D466,804 | S | 12/2002 | Solland | |
| 6,491,211 | B1 | 12/2002 | Evans et al. | |
| D546,669 | S | 7/2007 | Sheppard et al. | |
| D563,218 | S | 3/2008 | DeMalsche et al. | |
| D576,871 | S | 9/2008 | Sheppard et al. | |
| D577,286 | S | 9/2008 | Sheppard et al. | |
| 7,424,955 | B2 | 9/2008 | Chen | |
| D588,449 | S | 3/2009 | Bova et al. | |
| D600,110 | S | 9/2009 | Cain | |
| D601,009 | S | 9/2009 | Shinn | |
| D602,637 | S | 10/2009 | Helenowski | |
| 7,650,997 | B2 | 1/2010 | Nago | |
| D610,000 | S | 2/2010 | Schant | |
| D654,786 | S | 2/2012 | Rye et al. | |
| 8,191,707 | B2 * | 6/2012 | McDonald et al. | 206/326 |
| 8,235,204 | B2 | 8/2012 | Loughman et al. | |
| D671,401 | S | 11/2012 | Grabes et al. | |
| D679,950 | S | 4/2013 | Cooper | |
| 8,584,843 | B2 | 11/2013 | Hillard | |
| D699,103 | S | 2/2014 | Rathbone et al. | |
| D699,562 | S | 2/2014 | Klauder | |
| D700,049 | S | 2/2014 | Athay | |
| D702,546 | S | 4/2014 | McAdam | |
| D710,713 | S | 8/2014 | Fath | |
| D732,384 | S | 6/2015 | Fath | |
| D734,145 | S | 7/2015 | Fath et al. | |
| D735,572 | S | 8/2015 | Fath et al. | |
| D738,716 | S | 9/2015 | Nettenstrom et al. | |
| D743,248 | S | 11/2015 | Fath et al. | |
| D746,699 | S | 1/2016 | Fath | |
| D746,700 | S | 1/2016 | Boehnen et al. | |
| D755,044 | S | 5/2016 | Nettenstrom et al. | |
| D756,780 | S | 5/2016 | Grove et al. | |
| D756,781 | S | 5/2016 | Grove et al. | |
| 9,527,643 | B2 | 12/2016 | Streich et al. | |
| D787,933 | S | 5/2017 | Sill et al. | |
| D797,550 | S | 9/2017 | Fath et al. | |
| D820,688 | S | 6/2018 | Fath | |
| 2004/0182917 | A1 * | 9/2004 | Watson | B65D 5/4212 229/162.7 |
| 2005/0045526 | A1 | 3/2005 | Constant et al. | |
| 2005/0236282 | A1 | 10/2005 | Huska | |
| 2006/0208051 | A1 * | 9/2006 | Chuang | B65D 5/4204 229/162.6 |
| 2007/0228130 | A1 * | 10/2007 | Arai | B65D 5/0227 229/200 |
| 2011/0297559 | A1 | 12/2011 | Davis | |
| 2012/0061290 | A1 * | 3/2012 | Delaunay et al. | 206/769 |
| 2012/0227753 | A1 | 9/2012 | Newton | |
| 2013/0001126 | A1 * | 1/2013 | Gu | B65D 5/4204 206/775 |
| 2013/0140200 | A1 * | 6/2013 | Scatterday | A24F 15/00 206/265 |
| 2013/0233743 | A1 * | 9/2013 | Hillard | B65D 5/60 206/273 |
| 2013/0342157 | A1 | 12/2013 | Liu | |
| 2014/0097103 | A1 | 4/2014 | Cameron | |
| 2014/0262871 | A1 | 9/2014 | Fath | |
| 2015/0342252 | A1 | 12/2015 | Fath | |
| 2016/0096658 | A1 | 4/2016 | Fath | |

FOREIGN PATENT DOCUMENTS

| | | | |
|---|---|---|---|
| CN | 201043070 | Y | 4/2008 |
| CN | 101353092 | A | 1/2009 |
| CN | 102232040 | A | 11/2011 |
| CN | 203186741 | U | 9/2013 |
| CN | 103619715 | A | 3/2014 |
| DE | 4339645 | A1 | 5/1995 |
| EP | 0465257 | A1 | 1/1992 |
| EP | 1818266 | A1 | 8/2007 |
| FR | 021175-001 | | 5/2002 |
| FR | 065761-001 | | 1/2010 |
| GB | 2106366 | | 5/2001 |
| RU | 46078 | S | 9/1999 |
| RU | 63280 | S | 7/2007 |
| WO | WO-DM/072141 | | 7/2009 |

OTHER PUBLICATIONS

Written Opinion dated Jun. 12, 2014, by the International Searching Authority, in corresponding International Appln. No. PCT/US2014/022719 (8 pages).

International Search Report and Written Opinion from corresponding International Application PCT/US2015/053518, dated Feb. 2, 2016.

Website http://alloy.ru (Dec. 24, 2012).

Written Opinion by the International Searching Authority in corresponding International Application PCT/US2014/022719, dated Jun. 12, 2014.

International Search Report and Written Opinion from corresponding International Application PCT/US2015/033253, dated Oct. 21, 2015.

Notification of Transmittal of International Preliminary Report on Patentability issued in corresponding International Application No. PCT/US2014/022719, dated Sep. 24, 2015.

HackYa, Philip Morris' Mark 10 Review, Apr. 24, 2014 [earliest online date], [site visited Oct. 19, 2016], URL:http://hackya.com/us/phillip-morris-mark-ten-review/.

Notification Concerning Transmittal of International Preliminary Report on Patentability and International Preliminary Report on Patentability issued in corresponding International Application PCT/US2015/033253, dated Dec. 8, 2016.

Office Action from corresponding Chinese patent application CN201480024177.3, dated Jan. 23, 2017.

Russian Search Report dated Feb. 26, 2018 in related Russian Application No. 2015144319/12(068246), with an English translation.

Russian Decision to Grant dated Feb. 28, 2018 in related Russian Application No. 2015144319/12(068246), with an English translation.

(56) References Cited

OTHER PUBLICATIONS

Eurasian Office Action dated Jun. 20, 2018, in related Eurasian Application No. 201692441, with an English translation.
European Office Action dated Oct. 11, 2018 in corresponding European Application No. 15756501.1.
Malaysian Office Action dated Nov. 15, 2018 in corresponding Malaysian Application No. PI 2015002388.
Chinese Decision on Rejection dated Dec. 29, 2018 in corresponding Chinese Application No. 201480024177.3.
Office Action dated Mar. 9, 2017 in related U.S. Appl. No. 29/541,752.
Final Office Action dated Mar. 30, 2017 in related U.S. Appl. No. 14/725,556.
Office Action dated Mar. 31, 2017 in related U.S. Appl. No. 14/872,786.
European Examination Report dated Jan. 12, 2018 in European Application No. 15 756 501.1.
Chinese Office Action dated Jan. 23, 2019 in corresponding Chinese Application No. 201580028674.5, with an English language translation.
Chinese Office Action dated May 9, 2018 in Chinese Application No. 201480024177.3, with an English translation.
Chinese Office Action dated May 3, 2018 in Chinese Application No. 201580028674.5, with an English translation.
U.S. Office Action dated May 26, 2017 in related U.S. Appl. No. 14/725,556.
U.S. Office Action dated Jan. 2, 2019 in related U.S. Appl. No. 29/644,638.
International Preliminary Report on Patentability dated Apr. 4, 2017, in related PCT/US2015/053518.
U.S. Office Action dated Aug. 24, 2017 in related U.S. Appl. No. 29/546,678.
U.S. Office Action dated Nov. 8, 2017 in related U.S. Appl. No. 14/725,556.
U.S. Office Action dated Sep. 21, 2017 in related U.S. Appl. No. 14/872,786.
Chinese Office Action dated Oct. 17, 2017 in related Chinese Application No. 201480024177.3, with English translation.

* cited by examiner

FIG. 3
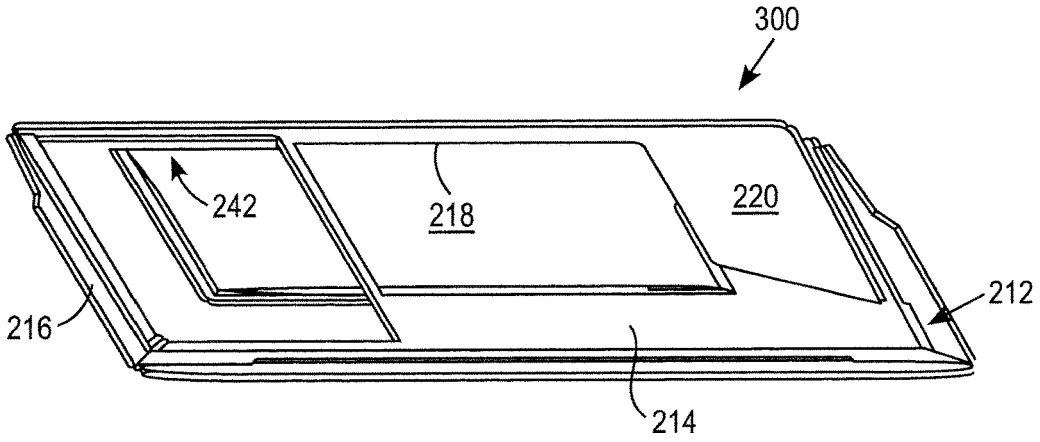
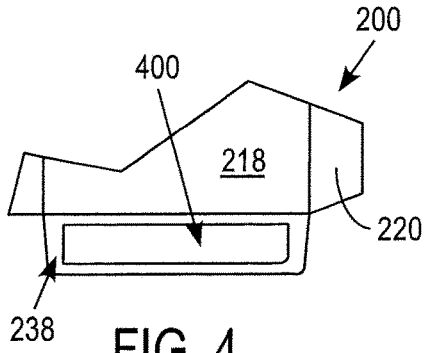
FIG. 4
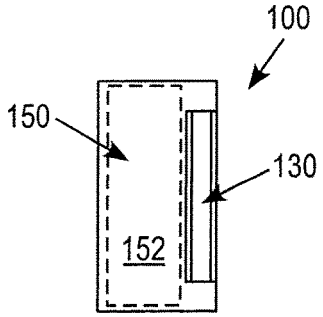
FIG. 5

DISPLAY PACKAGE

WORKING ENVIRONMENT

Electronic cigarettes emulate tobacco cigarettes, but without the combustion of tobacco during use. Rather than burning tobacco, a fluid is atomized within the electronic cigarette, which emulates the smoke produced in a tobacco cigarette. The fluid may contain flavoring agents such as tobacco flavor, menthol, and others, to enhance the "smoking" experience of the electronic cigarette.

SUMMARY

In accordance with an exemplary embodiment, a method of displaying an article, comprises: establishing a box structure having a side portion; dividing said side portion into a lower retention portion, and upper retention portion, and a window recess portion, said recess portion disposed between said upper and lower retention portions; said dividing including: establishing a first recess panel at a location along a side panel of said box structure; establishing a second recess panel along a front panel of said box structure, said second recess panel adjacent said first recess panel; and establishing said window recess portion by folding said first and second recess panels into said box structure; whereby said window recess portion, said upper retention portion and said lower retention portion are mutually arranged to retain said article along said side portion, with a portion of said article displayed along said recess portion.

In accordance with another exemplary embodiment, a package capable of displaying a selected portion of an article, comprises: a box structure having a side portion, said side portion divided into a lower retention portion, and upper retention portion, and a window recess portion, said recess portion disposed between said upper and lower retention portions; said recess portion comprising a first recess panel at a location along a side panel of said box structure and a second recess panel along a front panel of said box structure, said second recess panel adjacent said first recess panel, said first and second recess panels being folded into said box structure; whereby said window recess portion, said upper retention portion and said lower retention portion are mutually arranged to retain said article along said side portion, with a portion of said article being displayed along said recess portion.

In accordance with a further exemplary embodiment, a package capable of displaying a selected portion of an article, comprises: a tubular body configured to visibly contain the article; a box structure having a side portion, said side portion divided into a lower retention portion, and upper retention portion, and a window recess portion, said recess portion disposed between said upper and lower retention portions; said recess portion comprising a first recess panel at a location along a side panel of said box structure and a second recess panel along a front panel of said box structure, said second recess panel adjacent said first recess panel, said first and second recess panels being folded into said box structure; whereby said window recess portion, said upper retention portion and said lower retention portion are mutually arranged to retain said tubular body along said side portion, with a portion of said article being visible through said tubular portion along said recess portion.

In accordance with another exemplary embodiment, a blank for forming a rectangular box, which is operable to contain an elongate body, the blank comprises: a side panel connected to a front panel along a first fold line, the first fold line extending along a first side edge of the front panel; a cavity side panel connected to the front panel along a second fold line, the second fold line extending along a second side edge of the front panel; a back panel connected to the cavity side panel along a third fold line, the third fold line extending along a first side edge of the back panel; a first glue panel connected to the back panel along a fourth fold line, the fourth fold line extending along a second side edge of the back panel; a first dust panel connected to the side panel along a top edge of the side panel; a top panel connected to the front panel along a fifth fold line, the fifth fold line extending along a top edge of the front panel, the top panel having a upper flap panel and an end panel, and wherein the upper flap panel is connected to the end panel along a sixth fold line; a second dust panel connected to the cavity side panel along a top edge of the cavity side panel; a bottom panel connected to the front panel along a seventh fold line, the seventh fold line extending along a bottom edge of the front panel; a second glue panel connected to the back panel along an eighth fold line, the eighth fold line extending along a bottom edge of the back panel; and an upper and a lower cut line extending across an upper and a lower portion of the front panel adjacent to the cavity side panel and extending across the cavity side panel, respectively, and which forms a first cavity panel and a second cavity panel, and wherein upon assembly of the rectangular box, the first cavity panel and the second cavity panel are perpendicular to the front panel and the cavity side panel, respectively, forming a cavity, which is configured to receive the elongate body.

In accordance with a further exemplary embodiment, a method of packaging an elongate body, comprises: partially erecting a box from a blank so as to have an opening at a bottom of the box and an opening at a top of the box, the blank comprising: a side panel connected to a front panel along a first fold line, the first fold line extending along a first side edge of the front panel; a cavity side panel connected to the front panel along a second fold line, the second fold line extending along a second side edge of the front panel; a back panel connected to the cavity side panel along a third fold line, the third fold line extending along a first side edge of the back panel; a first glue panel connected to the back panel along a fourth fold line, the fourth fold line extending along a second side edge of the back panel; and an upper and a lower cut line extending across an upper and a lower portion of the front panel adjacent to the cavity side panel and extending across the cavity side panel, respectively, and which forms a first cavity panel and a second cavity panel; pre-folding the blank along the second fold line and the forth fold line; folding the blank along the first fold line and the third fold line, so that the side panel and the first glue panel overlap; applying glue to one or more of a back side of the cavity side panel or a backside side of the back panel and adhering the cavity side panel to the back panel; and applying glue to one or more of the side panel and the first glue panel to adhere the side panel and the first glue panel together.

In accordance with another exemplary embodiment, an electronic cigarette package configured to receive a body, comprises: a rectangular box portion having a side edge cavity formed between a front panel and a cavity side panel, wherein the side edge cavity includes a first cavity panel and a second cavity panel formed by an outer portion of the front panel and the cavity side panel, respectively, and wherein the rectangular box portion, the first cavity panel and the second cavity panel are perpendicular to the front panel and the cavity side panel, respectively.

BRIEF DESCRIPTION OF THE DRAWINGS

The disclosure is explained below with reference to the exemplary embodiments shown in the drawings. In the drawings:

FIG. 3 is a bottom view of a partially erected blank as shown in FIG. 2 in accordance with an exemplary embodiment.

FIG. 4 is a partial view of a second glue flap of a blank as shown in FIG. 2 in accordance with an exemplary embodiment.

FIG. 5 is a frontal view of an erected blank as shown in FIG. 2 in accordance with an exemplary embodiment.

DETAILED DESCRIPTION

In accordance with an exemplary embodiment, a blank 200 (FIG. 2) for forming a display package 100 (FIG. 1) operable to contain at least one electronic cigarette is disclosed. The at least one electronic cigarette can be held securely within an elongated hollow cylinder or tube within a view recess or side edge cavity 120 along an outer side edge portion of the package 100, such that the electronic cigarette is visible to a purchaser and/or consumer.

Figure 1:
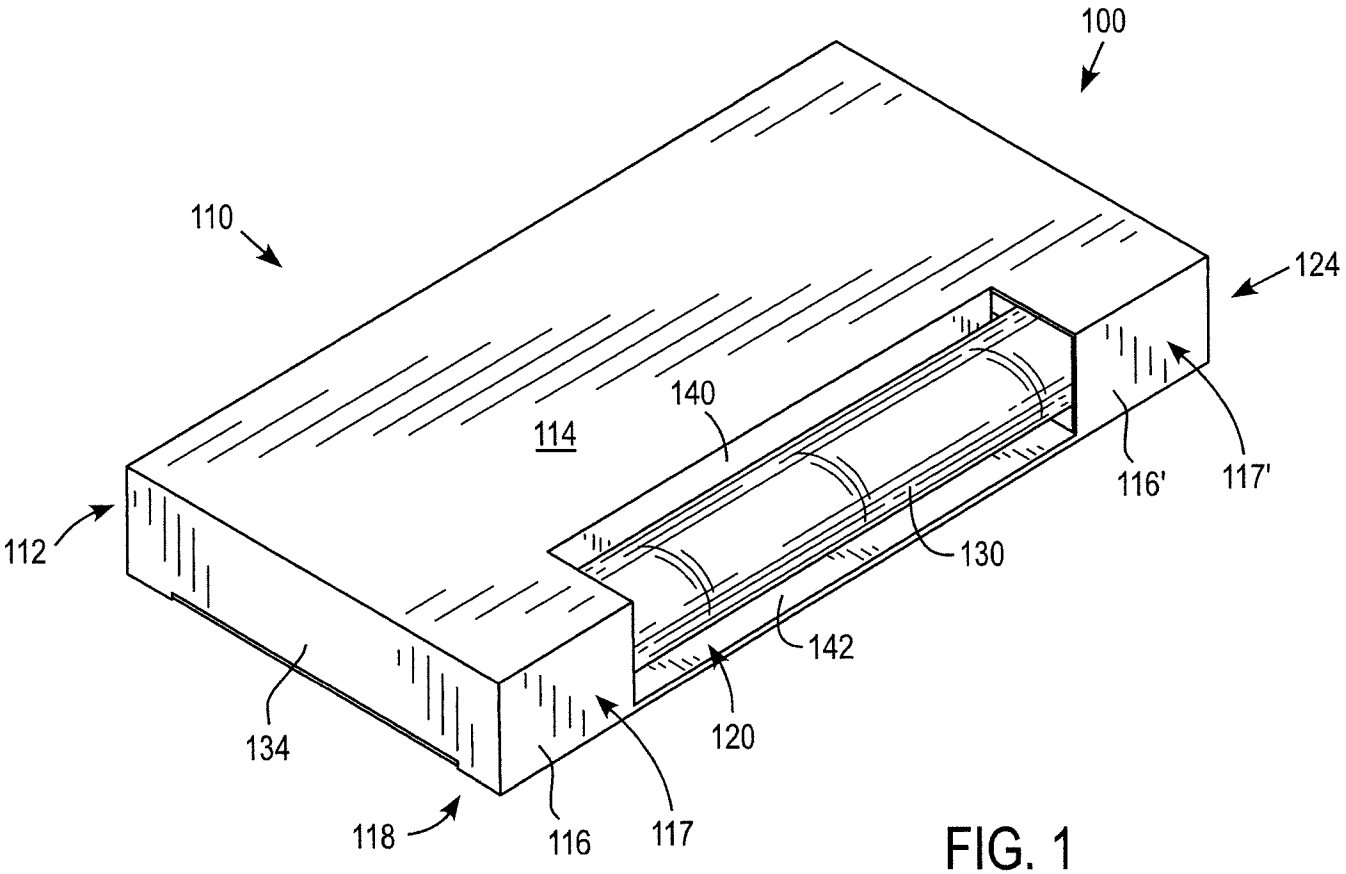
FIG. 1 is a perspective view of an electronic cigarette packaging in accordance with an exemplary embodiment.

FIG. 1 is a perspective view of an electronic cigarette packaging 100 in accordance with an exemplary embodiment. As shown in FIG. 1, the electronic cigarette packaging 100 includes a rectangular box portion 110, which is a substantially rectangular parallelepipedal shaped box, with right-angled longitudinal and right-angled transverse edges. The rectangular box portion 110 includes a viewing window or cavity 120, which is configured to receive an encased electronic cigarette. The electronic cigarette is preferably encased in a transparent/translucent, tubular or elongated hollow cylinder (or body) 130, which is configured to fit within the viewing recess or side edge cavity 120 of the box portion 110 of the electronic cigarette package 100. In accordance with an exemplary embodiment, the tubular or elongated hollow cylinder 130 is a transparent hollow cylinder having at least one removable cap or lid on one end and a closed or preferably non-removable cap or end on the opposite end. For example, in accordance with an exemplary embodiment, the elongated hollow cylinder 130 can be a clear glass or plastic tube.

Figure 6:
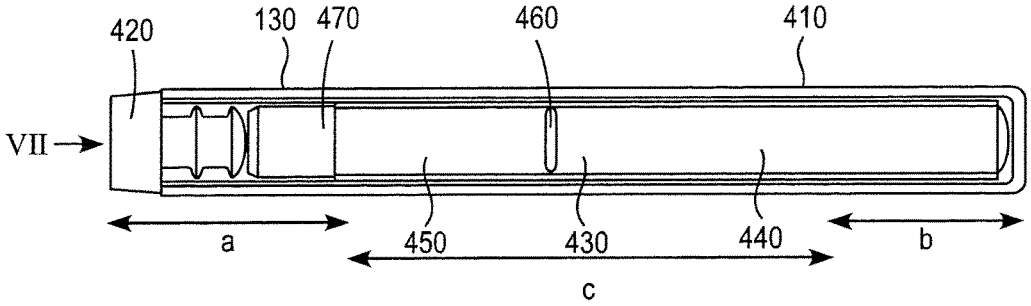
FIG. 6 is a side view of an elongate, tubular body which contains an exemplary electronic cigarette.
Figure 7:
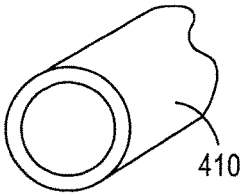
FIG. 7 is a perspective view from the general direction of arrow VII in FIG. 6 of a cylindrical tubular body.

Referring now to FIG. 6, in an embodiment the elongate tubular body 130 comprises a cylindrical, preferably transparent or translucent tube 410 and a removable cap 420 at the open end thereof. In the preferred embodiment, the contents comprise an electronic cigarette or electronic cigar 430 (collectively referenced as "electronic smoking article"). The electronic cigarette 430 may comprise a battery section 440 and a mouth piece or cartridge portion 450 and a coupling 460 between the two. Optionally, the electronic cigarette 430 includes a protective cover 470 over its buccal end portion. In a preferred embodiment, the upper and lower portions of the tubular body 130 are not visible and are covered by a front panel portion of the box 110, which portions are indicated by arrows a and b in FIG. 6. An intermediate portion "c" remains visible to the consumer through the window or viewing recess 120 of the box 110.

Figure 8:
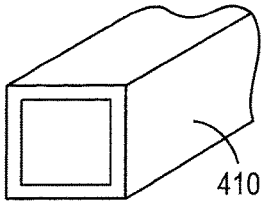
FIG. 8 is a perspective view from the general direction of arrow VII in FIG. 6 of a square elongate tubular body.
Figure 9:
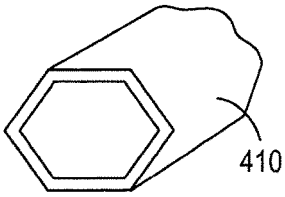
FIG. 9 is a perspective view from the general direction of arrow VII in FIG. 6 of a hexagonal elongate tubular body.
Figure 10:
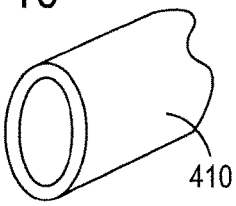
FIG. 10 is a perspective view from the general direction of arrow VII in FIG. 6 of an oval elongate body.

Although the preferred embodiment provides a cylindrical, elongate tubular body 410, the tubular body 410 and the cap 420 may be formed into other cross-sectional shapes such as shown in FIGS. 8-10, which show an elongate tubular body 410 having a square cross-section, a hexagonal cross-section and an oval cross-section, respectively. Other rounded or multi-faceted cross-sections may be employed.

In accordance with an exemplary embodiment, the rectangular box portion 110 includes a side panel 112, a front panel 114, a partial side panel 116, a back panel 118, a top panel 124, and a bottom panel 134. The viewing recess 120 within the rectangular box portion 110 is formed by folding inwardly a front recess panel 140 located along an outer edge or portion of a front panel 114 and a side recess panel 142 located along the side panel 116 of the rectangular box portion 110. When folded, the recess panels 140, 142 are preferably about 90 degrees (or perpendicular) to the front panel 114 and the cavity side panel 116, respectively. By appearances, the side panel 116 comprises an upper side panel portion 116 and a lower side panel portion 116', which are collectively referenced as side panel 116.

In accordance with an exemplary embodiment, the window or viewing cavity 120 extends a distance less than a height of the front panel 112 to establish retention portions 117, 117', which retain the end portions of elongated hollow cylinder 130 within box 110, with portion of the cylinder 130 viewable along the cavity 120. For example, in accordance with an exemplary embodiment, the length of the side edge cavity is less than the length of the hollow cylinder 130. In addition, the length of the hollow cylinder 130 can be substantially the same as the length of the front panel 114 so as to limit up-and-down movement of the cylinder (tube) 130 In addition, the ends (not shown) of the hollow cylinder 130 can be covered by the retention portions 117, 117' of the box 100. In accordance with an exemplary embodiment, the diameter of the hollow cylinder 130 is approximately the same as a width of the cavity or side edge cavity 120, and which corresponds to the width of the recess panels 140, 142.

Figure 2:
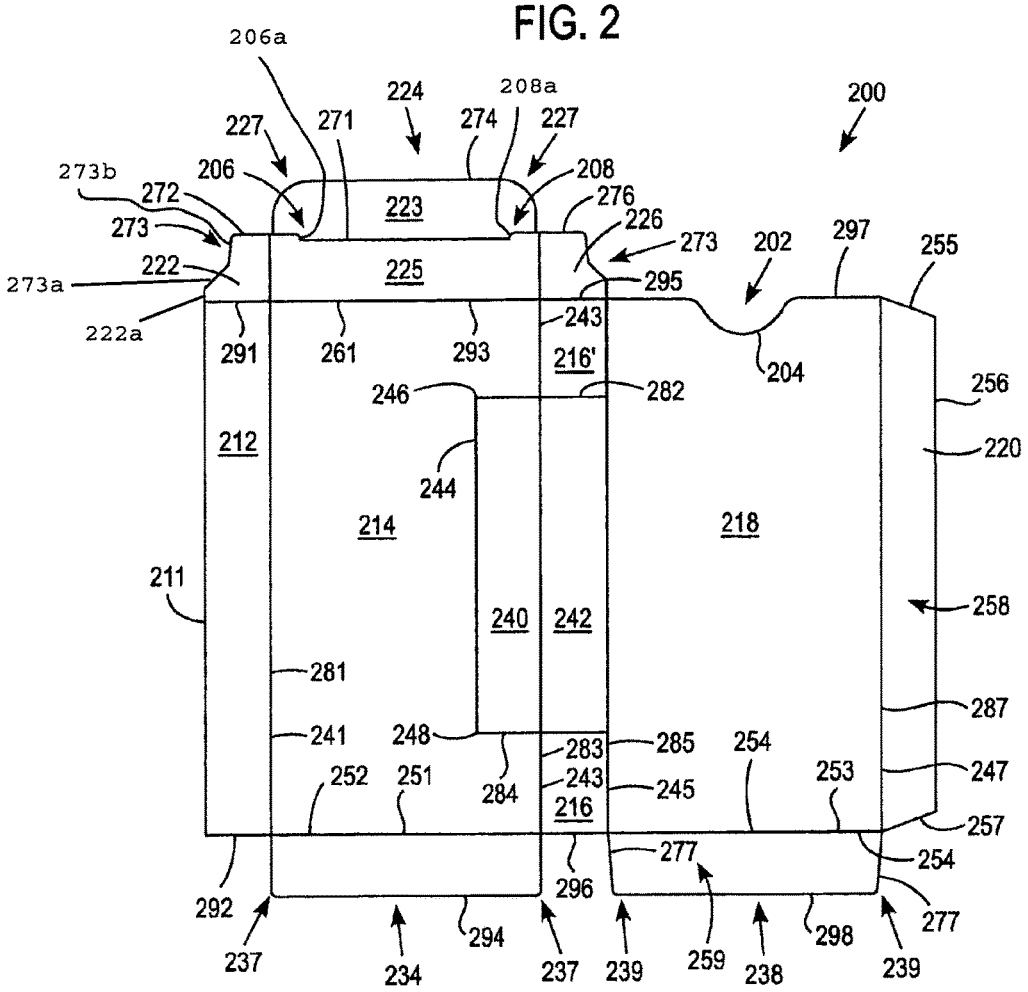
FIG. 2 is a blank for forming an electronic cigarette packaging in accordance with an exemplary embodiment.

In accordance with an exemplary embodiment, a blank 200 for forming a rectangular box 110 having a cavity 120, which is operable to contain a hollow elongated cylinder 130 is shown in FIG. 2. The blank 200 includes a first complete side panel 212 connected to a front panel 214 along a first fold line 241. The first fold line 241 extends along a first side edge 281 of the front panel 214. Upper and lower side panel portions, 216, 216' (collectively side panel 216) are connected to the front panel 214 along a second fold line 243. The second fold line 243 extends along a second side edge 283 of the front panel 214. A back panel 218 is connected to the cavity side panel 216 along a third fold line 245. The third fold line 245 extends along a first side edge 285 of the back panel 218. A first glue panel 220 connects to the back panel 218 along a fourth fold line 247. The fourth fold line 247 extends along a second side edge 287 of the back panel 218.

The blank 200 also includes a first dust panel 222 connected to the side panel 212 along a top edge 291 of the side panel 212. A top panel 224 is connected to the front panel 214 along a fifth fold line 261. The fifth fold line 261 extends along a top edge 293 of the front panel 214. In accordance with an exemplary embodiment, the top panel 224 has an upper flap panel (or tuck panel) 223 and an end (top) panel 225. The upper flap panel or tuck panel 223 is connected to the end panel 225 along a sixth fold line 271. A second dust panel 226 is connected to the cavity side panel 216 along a top edge 295 of the cavity side panel 216. An outer bottom panel 234 is connected to the front panel 214 along a seventh fold line 251. The seventh fold line 251 extends along a bottom edge 252 of the front panel 214. A second (inner) glue panel 238 is connected to the back panel 218 along an eighth fold line 253. The eighth fold line 253 extends along a bottom edge 254 of the back panel 218.

The blank 200 also includes an upper cut line 282 and a lower cut line 284 extending transversely across an upper and a lower portion of the front panel 214 adjacent to the upper and lower side panel portions 216, 216' and extending across the cavity side panel 216, respectively. The upper cut line 282 and the lower cut line 284 form a first cavity panel 240 and a second cavity panel 242 within the front panel 214 and between the side panel portions 216, 216', respectively. A ninth (scored) fold line 244 extends between an inner edge 246 of the upper cut line 282 and an inner edge 248 of the lower cut line 284 on the front panel 214.

In accordance with an exemplary embodiment, upon assembly of the box 110, the first cavity panel 240 and the second cavity panel 242 are positioned perpendicular to the front panel 214 and the cavity side panel 216, respectively. Panels 240 and 242 form the window or recess 120. In accordance with an exemplary embodiment, the cavity 120 receives the elongated hollow cylinder 130. In accordance with an exemplary embodiment, the upper and lower cut lines 282, 284 extend across the front panel 214 a distance equal to a width of the cavity side panel 216.

In accordance with an exemplary embodiment, the side panel 212 has a vertical free edge 211. The first side panel 212 and the cavity side panel 216, each includes a lower free edge 292, 296. In addition, each of the first and second dust panels 222, 226 has an outer edge 272, 276 with a slightly recessed portion 273 on the outer edge 272, 276 opposite to the front panel 214. Each recessed portion 273 (positioned above the side outer edge 222*a* ) includes an inwardly angled edge 273*a* , which extends inward towards the top outer edge 272 and a slightly vertical upper edge 273*b* extending to the outer edge 272. The top panel 224, the bottom panel 234, and the second glue panel 238, each have a free outer edge 274, 294, 298. The back panel 218 includes a recessed portion 202 within an upper edge 297 of the back panel 218, which provides assistance and/or access for a consumer to contents enclosed within the box 110 such as a booklet 150, which may be stored within the box portion 110 of the electronic cigarette packaging 100.

The blank 200 may include a finish or varnish on the clay (printable) side of the blank 200. In accordance with an exemplary embodiment, the first glue panel 220 and the second glue panel 238 can each include a varnish free area or portion 258, 259, which may improve the bonding formed by the glue, for example, a hot-melt adhesive material, and/or adhesive tape 400 (FIG. 4). In accordance with an exemplary embodiment, the first glue panel 220 has a pair of angled edges 255, 257, which are slightly tapered to a vertical free edge 256.

In accordance with an exemplary embodiment, the side panel 212 has a width of about 13.0 mm and a height of about 109 mm. The front panel 214 has a width of about 55 mm and a height of about 110 mm. The cavity side panel 216 (portions 216, 216') has a width of about 14.0 mm and a height of about 109 mm. The back panel 218 has a width of about 54.5 mm and a height of about 109 mm. The first glue panel 220 has a width of about 11.0 mm and a height of about 109 mm.

In accordance with an exemplary embodiment, the first cavity panel 240 and the second cavity panel 242 have a height of about 69 mm and a width of about 14.0 mm. In accordance with an exemplary embodiment, a distance from the cut lines 282, 284 to the upper edges 293, 295 of the front panel 214 and the cavity side panel 216, and the lower edges 252, 296 of the front panel 214 and the cavity side panel 216 is about 20 mm. In accordance with an exemplary embodiment, the cavity 120 has a height of about 69 mm and a width of about 14.0 mm and depth of about 14.0 mm.

In accordance with an exemplary embodiment, the first dust panel 222 has a width of about 13.0 mm and a height of about 12.5 mm. The upper flap panel or tuck panel 223 has a width of about 54 mm and a height of about 12.0 mm. In accordance with an exemplary embodiment, the corners of the tuck panel 223 are rounded 227. The end panel 225 has a width of about 55 mm and a height of about 12.5 mm. In accordance with an exemplary embodiment, the end panel 225 has a pair of slits 206, 208, parallel to the sixth fold line 271, with downward turning end slit portions 206*a*/208*a* contacting the sixth fold line 271. The second dust panel 226 has a width of about 14.0 mm and a height of about 12.4 mm. The bottom panel 234 has a width of about 55 mm and a height of about 12.0 mm. In accordance with an exemplary embodiment, the corners 237 of the bottom panel (or end panel) 234 are slightly round at a radius of about 1.0 mm.

In accordance with an exemplary embodiment, first glue panel 220 has a pair of angled outer edges 255, 257, which extend from the second side edge 287 of the back panel 218 inward at an angle of about 10 to 30 degrees and more preferably about 20 degrees. In accordance with an exemplary embodiment, the second glue panel 238 has a width of about 54.5 mm and a height of about 12.0 mm. The vertical edges 277 of the second glue panel 238 can be angled, for example, angled at about 2.5 to 7.5 degrees and more preferably about 5.0 degrees. In addition, the corners 239 of the second glue panel 238 can be rounded at a radius of about 1.0 mm.

In addition, the back panel 218 has a recess 202 on an upper edge 297 thereof. In accordance with an exemplary embodiment, the recess 202 can have a radius of about 9.3 mm and a depth of about 7 mm. The recess 202 is preferably located in a center portion of the upper edge 297 of the back panel 218 so as to provide an equal distance from the first side edge 285 and the second side edge 287 to a corresponding edge 204 of the recess 202.

In accordance with an exemplary embodiment, the assembled box has a height of about 111.0 mm, a width of about 55.0 mm and a depth of about 14.0 mm. In addition, in a flat state, the blank 200 has a height of 146.5 mm and a width of about 147.5 mm. In accordance with an exemplary embodiment, the partially assembled box 200 is shipped for assembly in a folded and glued format.

In accordance with exemplary embodiment, the blank 200 is formed of a material selected from the group consisting of cardboard, paperboard, plastic, metal, or combinations thereof. For example, in a preferred embodiment, the blank 200 is formed of cardboard having a weight ranging from about 100 grams per square meter to about 350 grams per square meter. In FIG. 2, the clay coated side of the blank 200 is shown.

In accordance with another exemplary embodiment, the blank 200 includes one or more of printing, embossing, debossing, embellishments and combinations thereof on an outer surface of the blank 200.

In the preferred embodiment, the blank 200 may be formed from any suitable materials including, but not limited to, cardboard, paperboard, plastic, metal, or combinations thereof. Preferably, the blank 200 is formed from one or more folded laminar cardboard blanks. Also preferably, the cardboard has a weight ranging from about 100 grams per square meter (gsm) to about 350 grams per square meter.

In the preferred embodiment, exterior surfaces of the box 110 may be printed, embossed, debossed or otherwise embellished with manufacturer or brand logos, trademarks, slogans and other consumer information and indicia.

In another embodiment, as shown in FIG. 3, a resultant box structure 300 from a method for assembling the box 110 from a single laminar blank 200 is provided. In accordance with an exemplary embodiment, the laminar blank 200 is preferably partially folded and glued prior to shipping to a facility for assembly.

In accordance with an exemplary embodiment, the second and fourth fold lines 243, 247 are folded 180 degrees. The first and third fold lines 241, 245 are then folded 180 degrees, and the second cavity panel 242, which comprises the area of the cavity side panel 216 between the upper cut line 282 and the lower cut line 284 is glued to an adjacent inside portion (not shown) of the back panel 218. The first glue panel 220 is then glued to a back side of the side panel 212.

In accordance with an exemplary embodiment, the resultant box 300 structure may be flattened to facilitate shipping. It is preferable that the resultant box 300 is supplied by the manufacturer folded and glued as set forth above. In addition, it is preferable that the resultant boxes 300 are not packed tightly so as to flatten them completely.

Figure 13:
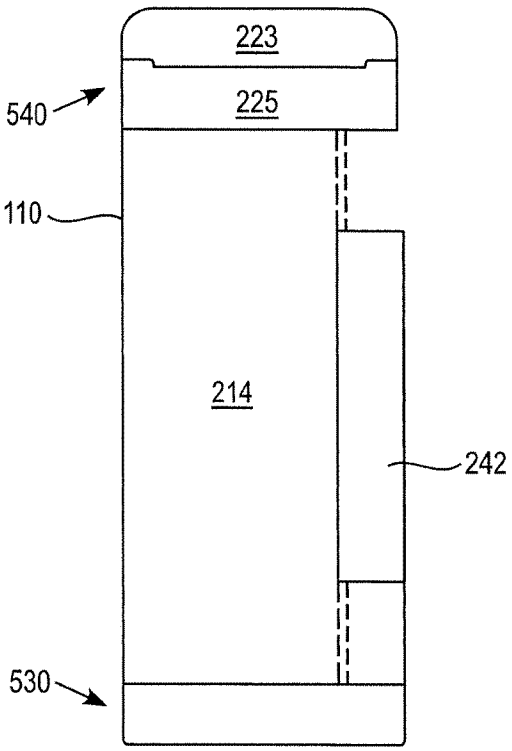
FIG. 13 is a planar front view of a glued, erected, open-ended, box structure in accordance with an exemplary embodiment.
Figure 14:
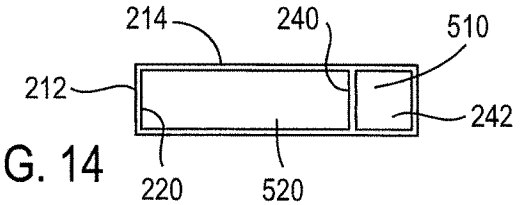
FIG. 14 is an end view of the box structure shown in FIG. 13.
Figure 12:
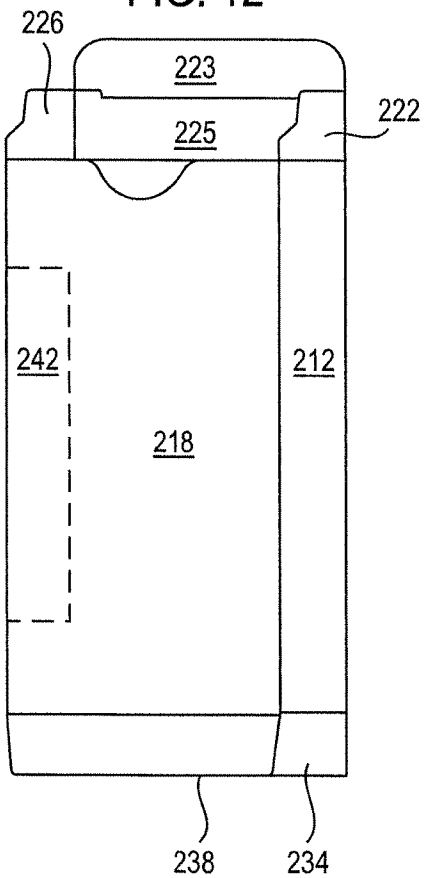
FIG. 12 is a planar rear view of a glued, un-erected box structure in accordance with an exemplary embodiment.
Figure 11:
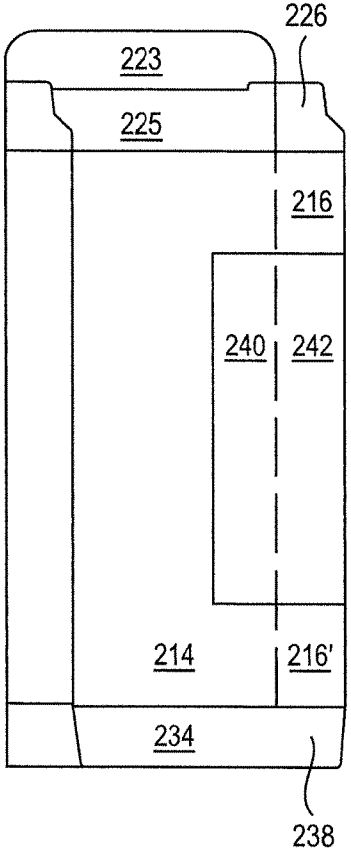
FIG. 11 is a planar front view of a glued, un-erected box structure in accordance with an exemplary embodiment.

In a preferred embodiment, a glued, yet un-erected box structure is shown in the frontal view of FIG. 11 wherein the window, recess panel 242 is glued to an interior surface of the back panel 218, the latter not being visible in FIG. 11. In the rear view of FIG. 12, a representation of window panel 242 is shown in dashed lines. Referring now to FIGS. 13 and 14, upon erection, an open-ended structure of box 110 is established wherein a windowed compartment 510 is established adjacent the side panel 216. Referring now also to FIG. 1, the windowed compartment 510 comprises the lower retention portion 117 (defined between adjacent, lower portions of the side, front and back panels 116, 114, 118) of the box 110, the window 120 (defined by the window panels 140, 142) and the upper retention portion 117' (defined between adjacent, upper portions of the side, front and back panels 116', 114, 118 of the box 110).

Referring back to FIG. 14, the open-ended structure of the box 110 further comprises in the exemplary embodiment, a second optional compartment 520 which is provided within the remainder of the confines of the box 110 for housing pamphlets or supplementary devices such as wall chargers, electrical connectors or the like. Insertion of a tubular body 130 into the windowed compartment 520 and closure of end portions 530 and 540 of the box 110 completes the packaging 100 of the exemplary embodiment shown in FIG. 1.

Figure 15:
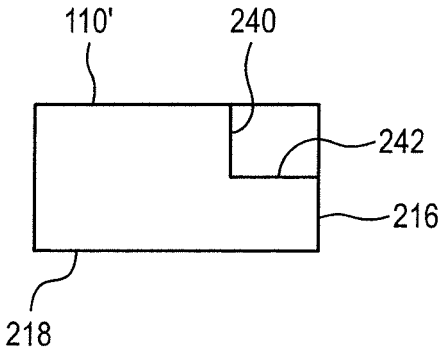
FIG. 15 is a representation of and in view of an alternate box structure having a greater depth then the exemplary embodiment shown in FIG. 1.
Figure 16:
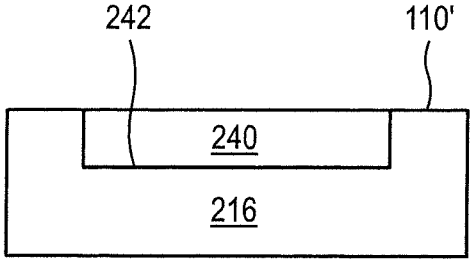
FIG. 16 is a side view representation of the exist alternate embodiment of FIG. 15.

It is contemplated that the proportions of the box 110 may be changed to provide a greater depth such as shown in FIG. 15 and/or a greater height. In an embodiment wherein the width of side panel 216 is increased to create a greater depth, the window panel 242 would not necessarily be glued to adjacent portions of the back panel 218. In erection of such a box 110', the window recess 120 would be established by either manually or mechanically pushing (folding) panels 240 and 242 inwardly into the box structure 110' upon erection of the box structure 110'. In this embodiment, the lower and upper retention portions 117, 117' comprise on adjacent portions of the front panel 114 and the side panels portions 116, 116'.

In all configurations, it is contemplated that the retention portions 117, 117' may serve to block from view selected portions of the tubular body 130, such as for example, the stopper 410. Furthermore, the retention portions 117, 117' preferably each have a sufficient length to provide adequate resistance against someone pulling the product laterally apart from the box structure 110.

It is contemplated the box 110 may be provided tuck flaps at both ends, instead of at only the top end as shown FIG. 2.

FIG. 4 is a partial view of a glue flap 238 of the blank 200 as shown in FIG. 2 in accordance with an exemplary embodiment. As shown in FIG. 4, a pressure sensitive tape 400 can be used to attach or fix the first glue flap 220 to the side panel 212 and/or the second glue flap 238 to the bottom panel 234. For example, in accordance with an exemplary embodiment, a pressure sensitive tape 400 having a width of about 40.5 mm and a height of less than about 11.0 mm can be placed on the second glue flap 238 at a distance of about 1.0 mm from a lower edge 298 of the second glue flap 238. In accordance with an exemplary embodiment, the pressure sensitive tape 400 is about 7.0 mm from the angled edges of the second glue flap 238. In accordance with an exemplary embodiment, the pressure sensitive tape 400 is a 3M® Extended Liner Tape 476XL having a ½ inch wide liner and ¼ inch adhesive.

FIG. 5 is a frontal view of an electronic cigarette package 100 as shown in FIG. 1. In accordance with an exemplary embodiment, the package 100 includes an instruction booklet 150 contained within an inner portion 152 of the package 100.

As used herein, the terms "front", "back", "upper", "lower", "side", "top", "bottom", "left", "right" and other terms used to describe relative positions of the components of the box refer to the box 110 in an upright position.

In accordance with an exemplary embodiment, the fold and/or score lines are 2 pt. rule.

As used herein, the term "longitudinal" refers to a direction from bottom to top or vice versa of the box 110. The term "transverse" refers to a direction perpendicular to the longitudinal direction.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness. In addition, cut line extends partially into and/or completely through the material along the desired line of weakness so as to separate one portion of a panel or panels from another portion of a panel or panels.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a box. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A package for displaying a selected portion of an article, comprising:

a box structure having a top portion and a side portion, said side portion being divided into a lower retention portion, upper retention portion, and a window recess portion, said window recess portion disposed between said upper and lower retention portions, said window recess portion including, a first recess panel at a location along a side panel of said box structure, a backside of said first recess panel being bonded to an adjacent interior surface of a back panel of said box structure, and a second recess panel along a front panel of said box structure, said second recess panel being adjacent to said first recess panel, and said first and second recess panels being folded into said box structure, said window recess portion, said upper retention portion and said lower retention portion being mutually arranged to retain said article along said side portion, with a portion of said article being displayed along said window recess portion, said top portion including, an upper flap panel connected to an end panel, a first horizontal slit and a second horizontal slit being defined by a border between the end panel and the upper flap panel on respective first and second sides of the end panel, the end panel and the upper flap panel further defining a first downward turning end slit portion on an end of the first horizontal slit, and a second downward turning end slit portion on an end of the second horizontal slit, a first dust panel and a second dust panel each including, a side outer edge adjacent to a recessed portion, the recessed portion including an inwardly angled edge and a substantially vertical upper edge, the inwardly angled edge being directly adjacent to the side outer edge and the substantially vertical upper edge being directly adjacent to an end outer edge, wherein the box structure is erected from a blank, the blank including the upper flap panel, the end panel, the first dust panel and the second dust panel, the first horizontal slit and the second horizontal slit of the blank each being aligned with the respective end outer edges of the first dust panel and the second dust panel.

2. The package of claim 1, wherein said lower and upper retention portions block portions of said article from view.

3. The package of claim 1, wherein the blank includes, a cavity side panel connected to the front panel, the back panel connected to the cavity side panel, the back panel having a longitudinal length, a first glue panel connected to the back panel, the first glue panel spanning along the longitudinal length of the back panel, a bottom panel connected to the front panel, and a second glue panel connected to the back panel, the second glue panel being attachable to the bottom panel with a pressure sensitive tape.

4. The package of claim 3, wherein the blank further includes, the side panel connected to the front panel along a first fold line, the first fold line extending along a first side edge of the front panel;

the cavity side panel connected to the front panel along a second fold line, the second fold line extending along a second side edge of the front panel;

the back panel connected to the cavity side panel along a third fold line, the third fold line extending along a first side edge of the back panel;

the first glue panel connected to the back panel along a fourth fold line, the fourth fold line extending along a second side edge of the back panel;

the first dust panel connected to the side panel along a top edge of the side panel;

the end panel connected to the front panel along a fifth fold line, the fifth fold line extending along a top edge of the front panel, wherein the upper flap panel is connected to the end panel along a sixth fold line;

the second dust panel connected to the cavity side panel along a top edge of the cavity side panel;

the bottom panel connected to the front panel along a seventh fold line, the seventh fold line extending along a bottom edge of the front panel;

the second glue panel connected to the back panel along an eighth fold line, the eighth fold line extending along a bottom edge of the back panel; and an upper and a lower cut line extending across an upper and a lower portion of the front panel adjacent to the cavity side panel and extending across the cavity side panel, respectively, so as to form a first cavity panel and a second cavity panel, and upon assembly of the box structure, the first cavity panel and the second cavity panel is perpendicular to the front panel and the cavity side panel, respectively, so as to form a first cavity configured to receive the article.

5. A package for displaying a portion of an article, comprising:

a tubular body configured to visibly contain the article, the tubular body being closed at a first end and having a removable cap at a second end opposing the first end; and a box structure having a top portion and a side portion, said side portion divided into a lower retention portion, an upper retention portion, and a window recess portion, and said window recess portion disposed between said upper and lower retention portions, said window recess portion including, a first recess panel at a location along a side panel of said box structure, a backside of said first recess panel being bonded to an adjacent interior surface of a back panel of said box structure, and a second recess panel along a front panel of said box structure, said second recess panel being adjacent to said first recess panel, and said first and second recess panels being folded into said box structure, said top portion including, an upper flap panel connected to an end panel, a first horizontal slit and a second horizontal slit being defined by a border between the end panel and the upper flap panel on respective first and second sides of the end panel, the end panel and the upper flap panel further defining a first downward turning end slit portion on an end of the first horizontal slit, and a second downward turning end slit portion on an end of the second horizontal slit, and a first dust panel and a second dust panel each including, a side outer edge adjacent to a recessed portion, the recessed portion including an inwardly angled edge and a substantially vertical upper edge, the inwardly angled edge being directly adjacent to the side outer edge and the substantially vertical upper edge being directly adjacent to an end outer edge, wherein the box structure is erected from a blank, the blank including the upper flap panel, the end panel, the first dust panel and the second dust panel, the first horizontal slit and the second horizontal slit of the blank each being aligned with the respective end outer edges of the first dust panel and the second dust panel, and said window recess portion, said upper retention portion and said lower retention portion being mutually arranged to retain said tubular body along said side portion, with a portion of said article being visible through said tubular body along said window recess portion.

6. The package of claim 5, wherein said lower and upper retention portions block portions of said article from view.

7. The package of claim 5, wherein said tubular body is cylindrical.

8. The package of claim 5, wherein said tubular body is oval in cross-section.

9. The package of claim 5, wherein said tubular body is square in cross-section.

10. The package of claim 5, wherein said tubular body is facetted in cross-section.

11. The package of claim 5, wherein the blank includes, a cavity side panel connected to the front panel, the back panel connected to the cavity side panel, the back panel having a longitudinal length, a first glue panel connected to the back panel, the first glue panel spanning along the longitudinal length of the back panel, a bottom panel connected to the front panel, and a second glue panel connected to the back panel, the second glue panel being attachable to the bottom panel with a pressure sensitive tape.

12. The package of claim 11, wherein the blank further includes, the side panel connected to the front panel along a first fold line, the first fold line extending along a first side edge of the front panel;

the cavity side panel connected to the front panel along a second fold line, the second fold line extending along a second side edge of the front panel;

the back panel connected to the cavity side panel along a third fold line, the third fold line extending along a first side edge of the back panel;

the first glue panel connected to the back panel along a fourth fold line, the fourth fold line extending along a second side edge of the back panel;

the first dust panel connected to the side panel along a top edge of the side panel;

a top panel connected to the front panel along a fifth fold line, the fifth fold line extending along a top edge of the front panel, wherein the upper flap panel is connected to the end panel along a sixth fold line;

the second dust panel connected to the cavity side panel along a top edge of the cavity side panel;

the bottom panel connected to the front panel along a seventh fold line, the seventh fold line extending along a bottom edge of the front panel;

the second glue panel connected to the back panel along an eighth fold line, the eighth fold line extending along a bottom edge of the back panel; and an upper and a lower cut line extending across an upper and a lower portion of the front panel adjacent to the cavity side panel and extending across the cavity side panel, respectively, so as to form a first cavity panel and a second cavity panel, and upon assembly of the box structure, the first cavity panel and the second cavity panel are perpendicular to the front panel and the cavity side panel, respectively, so as to form a first cavity configured to receive the tubular body.

13. A blank for forming a rectangular box, which is operable to contain an elongated body, the blank comprising:

a side panel connected to a front panel along a first fold line, the first fold line extending along a first side edge of the front panel;

a cavity side panel connected to the front panel along a second fold line, the second fold line extending along a second side edge of the front panel;

a back panel connected to the cavity side panel along a third fold line, the third fold line extending along a first side edge of the back panel, and a recess being within an upper edge of the back panel;

a first glue panel connected to the back panel along a fourth fold line, the fourth fold line extending along a second side edge of the back panel;

a top panel connected to the front panel along a fifth fold line, the fifth fold line extending along a top edge of the front panel, the top panel having an upper flap panel and an end panel, and the upper flap panel being connected to the end panel along a sixth fold line, a first horizontal slit and a second horizontal slit being defined by a border between the end panel and the upper flap panel on respective first and second sides of the top panel, the end panel and the upper flap panel further defining a first downward turning end slit portion on an end of the first horizontal slit, and a second downward turning end slit portion on an end of the second horizontal slit;

a bottom panel connected to the front panel along a seventh fold line, the seventh fold line extending along a bottom edge of the front panel;

a second glue panel connected to the back panel along an eighth fold line, the eighth fold line extending along a bottom edge of the back panel; and an upper and a lower cut line extending across an upper portion and a lower portion of the front panel adjacent to the cavity side panel and extending across the cavity side panel, respectively, so as to form a first cavity panel and a second cavity panel, upon assembly of the rectangular box, the first cavity panel and the second cavity panel being perpendicular to the front panel and the cavity side panel, respectively, so as to form a cavity configured to receive the elongated body, a first dust panel and a second dust panel each including, a side outer edge adjacent to a recessed portion, the recessed portion including an inwardly angled edge and a substantially vertical upper edge, the inwardly angled edge being directly adjacent to the side outer edge and the substantially vertical upper edge being directly adjacent to a top outer edge, wherein the first horizontal slit and the second horizontal slit each are aligned with the respective top outer edges of the first dust panel and the second dust panel.

14. The blank of claim 13, further comprising:

a ninth fold line connecting an inner edge of the upper cut line and an inner edge of the lower cut line on the front panel.

15. The blank of claim 13, wherein the front panel and the back panel are substantially a same width.

16. The blank of claim 13, wherein the side panel and the cavity side panel are substantially a same width.

17. The blank of claim 13, wherein the blank is formed of a material selected from cardboard, paperboard, plastic, metal, or combinations thereof.

18. The blank of claim 13, wherein the blank is formed of cardboard having a weight ranging from about 100 grams per square meter to about 350 grams per square meter.

19. The blank of claim 13, wherein the blank includes one or more of printing, embossing, debossing, embellishments or combinations thereof on an outer surface of the blank.

20. The blank of claim 13, wherein the first glue panel is attachable to the side panel with a first pressure sensitive tape, and the second glue panel is attachable to the bottom panel with a second pressure sensitive tape.

21. The blank of claim 13, wherein the upper and lower cut lines extend across the front panel a distance equal to a width of the cavity side panel.

22. The blank of claim 13, wherein, the first horizontal slit and the second horizontal slit are parallel to the sixth fold line, and the first and second downward turning end slit portions contact the sixth fold line.

23. A package configured to receive an elongated body, comprising:

a rectangular box portion having a side edge cavity formed between a front panel and a cavity side panel, the side edge cavity including a first cavity panel and a second cavity panel formed by an outer portion of the front panel and the cavity side panel, respectively, a backside of said second cavity panel being bonded to an adjacent interior surface of a back panel of said rectangular box portion, the first cavity panel and the second cavity panel being perpendicular to the front panel and the cavity side panel, respectively, and the rectangular box portion being erected from a blank, the blank including, the cavity side panel connected to the front panel, the back panel connected to the cavity side panel, the back panel having a longitudinal length, a first glue panel connected to the back panel, the first glue panel spanning along the longitudinal length of the back panel, a bottom panel connected to the front panel, a second glue panel connected to the back panel, the second glue panel being attachable to the bottom panel with a pressure sensitive tape, a top panel connected to an upper portion of the front panel, the top panel including an end panel and an upper flap panel, the upper flap panel being connected to the top panel, a first horizontal slit and a second horizontal slit being defined by a border between the end panel and the upper flap panel on respective first and second sides of the end panel, the end panel and the upper flap panel further defining a first downward turning end slit portion on an end of the first horizontal slit, and a second downward turning end slit portion on an end of the second horizontal slit, and a first dust panel and a second dust panel each including, a side outer edge adjacent to a recessed portion, the recessed portion including an inwardly angled edge and a vertical upper edge, the inwardly angled edge being directly adjacent to the side outer edge and the vertical upper edge being directly adjacent to a top outer edge, wherein the first horizontal slit and the second horizontal slit each are aligned with the respective top outer edges of the first dust panel and the second dust panel.

24. The package of claim 23, wherein the blank includes, a side panel connected to the front panel along a first fold line, the first fold line extending along a first side edge of the front panel;

the cavity side panel connected to the front panel along a second fold line, the second fold line extending along a second side edge of the front panel;

the back panel connected to the cavity side panel along a third fold line, the third fold line extending along a first side edge of the back panel;

the first glue panel connected to the back panel along a fourth fold line, the fourth fold line extending along a second side edge of the back panel;

the first dust panel connected to the side panel along a top edge of the side panel;

the top panel connected to the front panel along a fifth fold line, the fifth fold line extending along a top edge of the front panel, wherein the upper flap panel is connected to the end panel along a sixth fold line;

the second dust panel connected to the cavity side panel along a top edge of the cavity side panel;

the bottom panel connected to the front panel along a seventh fold line, the seventh fold line extending along a bottom edge of the front panel;

the second glue panel connected to the back panel along an eighth fold line, the eighth fold line extending along a bottom edge of the back panel; and an upper and a lower cut line extending across an upper and a lower portion of the front panel adjacent to the cavity side panel and extending across the cavity side panel, respectively, so as to form the first cavity panel and the second cavity panel, and upon assembly of the rectangular box, the first cavity panel and the second cavity panel being perpendicular to the front panel and the cavity side panel, respectively, so as to form a first cavity configured to receive the elongated body.

25. The package of claim 23, wherein the elongated body is an elongated transparent tubular body contained within the side edge cavity, the elongated transparent tubular body being visible within the side edge cavity.

26. The package of claim 23, further comprising:

a second cavity within the rectangular box portion, items in the second cavity not being visible.

27. The package of claim 23, wherein a length of the side edge cavity is less than a length of the elongated body.

28. The package of claim 23, wherein a length of the elongated body is substantially the same as a length of the front panel and ends of the elongated body are covered by portions of the front panel.

29. The package of claim 23, wherein a diameter of the elongated body is approximately the same as a width of the side edge cavity.

30. The package of claim 24, wherein the back panel includes an upper edge defining a recess.

* * * * *